US006789598B2

(12) United States Patent
Nien

(10) Patent No.: US 6,789,598 B2
(45) Date of Patent: Sep. 14, 2004

(54) LIFT LOCK FOR BLIND

(75) Inventor: Ming Nien, Changhua Hsien (TW)

(73) Assignee: Nien Made Enterprise Co., LTD, Taichung (TW)

( * ) Notice: Subject to any disclaimer, the term of this patent is extended or adjusted under 35 U.S.C. 154(b) by 0 days.

(21) Appl. No.: 10/393,261

(22) Filed: Mar. 21, 2003

(65) Prior Publication Data

US 2004/0112551 A1 Jun. 17, 2004

(51) Int. Cl.[7] ..... E06B 9/322

(52) U.S. Cl. ..... 160/172; 160/170; 188/72.7; 192/223.3

(58) Field of Search ..... 160/170, 171, 160/178.1 R, 178.2, 173 R, 297, 299; 188/72.7; 192/223.3

(56) References Cited

U.S. PATENT DOCUMENTS 2,783,861 A * 3/1957 Jungles ..... 192/223.3
4,383,593 A * 5/1983 Micke ..... 188/71.4
5,000,294 A * 3/1991 Hunnicutt et al. ..... 188/71.9
5,012,901 A * 5/1991 Campbell et al. ..... 188/71.4
6,394,236 B1 * 5/2002 Matsuishita ..... 188/72.7
6,464,061 B1 * 10/2002 Inoue et al. ..... 192/223.3

* cited by examiner

*Primary Examiner*—Blair M. Johnson
(74) *Attorney, Agent, or Firm*—Bacon & Thomas PLLC

(57) ABSTRACT

A lift lock for a blind is disclosed to include a casing holding a guide wheel, balls respectively received in respective sliding grooves around one side of the guide wheel, a shaft inserted through the casing and coupled to a lift rod of the blind, and a spring member sleeved onto the shaft for forcing an engagement portion of the shaft into engagement with a positioning opening of the casing. When the torque inputted into the lift rod surpassed the friction resistance between the casing and the shaft, the balls force the shaft to disengage the engagement portion from the positioning opening of the casing for enabling the lift rod to be freely rotated. When the input torque of the lift rod dropped, the spring member returns the shaft into engagement with the positioning opening of the casing to stop the lift rod in position.

10 Claims, 4 Drawing Sheets

LIFT LOCK FOR BLIND

BACKGROUND OF THE INVENTION

1. Field of the Invention

The present invention relates generally to blinds and, more specifically, to a lift lock used in a blind to lock the lift rod.

2. Description of the Related Art

A conventional Venetian blinds uses a lift cord to control the extending status, and bladder tapes to share the weight of the blind slats. When receiving the blind, the lift cord starts to bear the weight of the blind slats. When the blind slats received in a stack between the headrail and the bottom rail, the lift cords bears the total weight of the blind slats. When lifting or lowering the blind slats, the user needs only to pull the suspending part of the lift cord outside the headrail. However, because the suspended part of the lift cord is exposed to the outside of the headrail and easily accessible by a child, the suspending part of the lift cord may be hung on a child's head accidentally. In order to eliminate this problem, blinds with hidden lift cord are disclosed. A blind with hidden lift cord comprises a lift rod fastened pivotally with the inside of the headrail, and a spring mechanism mounted inside the headrail and coupled to the lift rod. The lift rod can be rotated to roll up or let off the lift cord, so as to further lift or lower the bottom rail of the blind. The spring power of the spring mechanism bears the weight of the bottom rail as well as the blind slats and is maintained in balance with the torque of the lift rod, enabling the blind to be positioned in the desired extending position. During operation, the user needs only to impart an upward or downward pressure to break the balance, i.e., when the user lowering or lifting the bottom rail and then releasing the hand from the bottom rail, the reversing force of the spring mechanism balances the torque of the lift rod, thereby keeping the blind in position. In order to keep the spring force of the spring mechanism in balance with the torque of the lift rod at different elevations, a variable adjusting means is provided in the spring mechanism to automatically regulate the reversing force of the spring mechanism subject to the elevation of the blind. Alternatively, the bottom rail may be made relatively heavier and the blind slats relatively lighter to control the variation of load within 15%. However, the aforesaid conventional designs cannot accurately lock the blind in position. When the spring power of the spring mechanism designed to be excessively high, the blind tends to be lifted slightly after pulled to the desired elevation, and cannot be set in the fully extended position. When the spring power of the spring mechanism designed to be insufficient or when the spring mechanism started to wear, the blind tends to be lowered slightly after pulled to the desired elevation, and cannot be fully received in the upper limit position.

Therefore, it is desirable to provide a lift control for blind that eliminates the aforesaid drawbacks.

SUMMARY OF THE INVENTION

It is one object of the present invention to provide a lift lock for blind, which is made in the form of an independent module.

It is another object of the present invention to provide a lift lock for blind, which achieves accurate positioning of the lift rod of the blind.

It is still another object of the present invention to provide a lift lock for blind, which is inexpensive to manufacture and easy to install.

It is still another object of the present invention to provide a lift lock for blind, which has a compact and simple structure that requires less installation space.

To achieve these objects of the present invention, the lift lock for locking position of a lift rod of a blind when a rotary driving force applied to the lift rod is dropped below a predetermined value comprises a shaft, a guide wheel, balls, a casing, a spring member and a retainer. The shaft is adapted to receive the lift rod of the blind. The balls are respectively received in respective sliding grooves around one side of the guide wheel which is sleeved onto the shaft. The retainer is coupled to the shaft. The spring member is sleeved onto the shaft for forcing an engagement portion of the shaft into engagement with a positioning opening of the casing. When the lift rod rotated by an external rotary driving force that surpasses the friction resistance between the shaft and the casing, the shaft is rotated with the lift rod. When the external rotary driving force dropped below the friction resistance between the shaft and the casing, the shaft is stopped to hold down the lift rod in position.

DETAILED DESCRIPTION OF THE INVENTION

Figure 1:
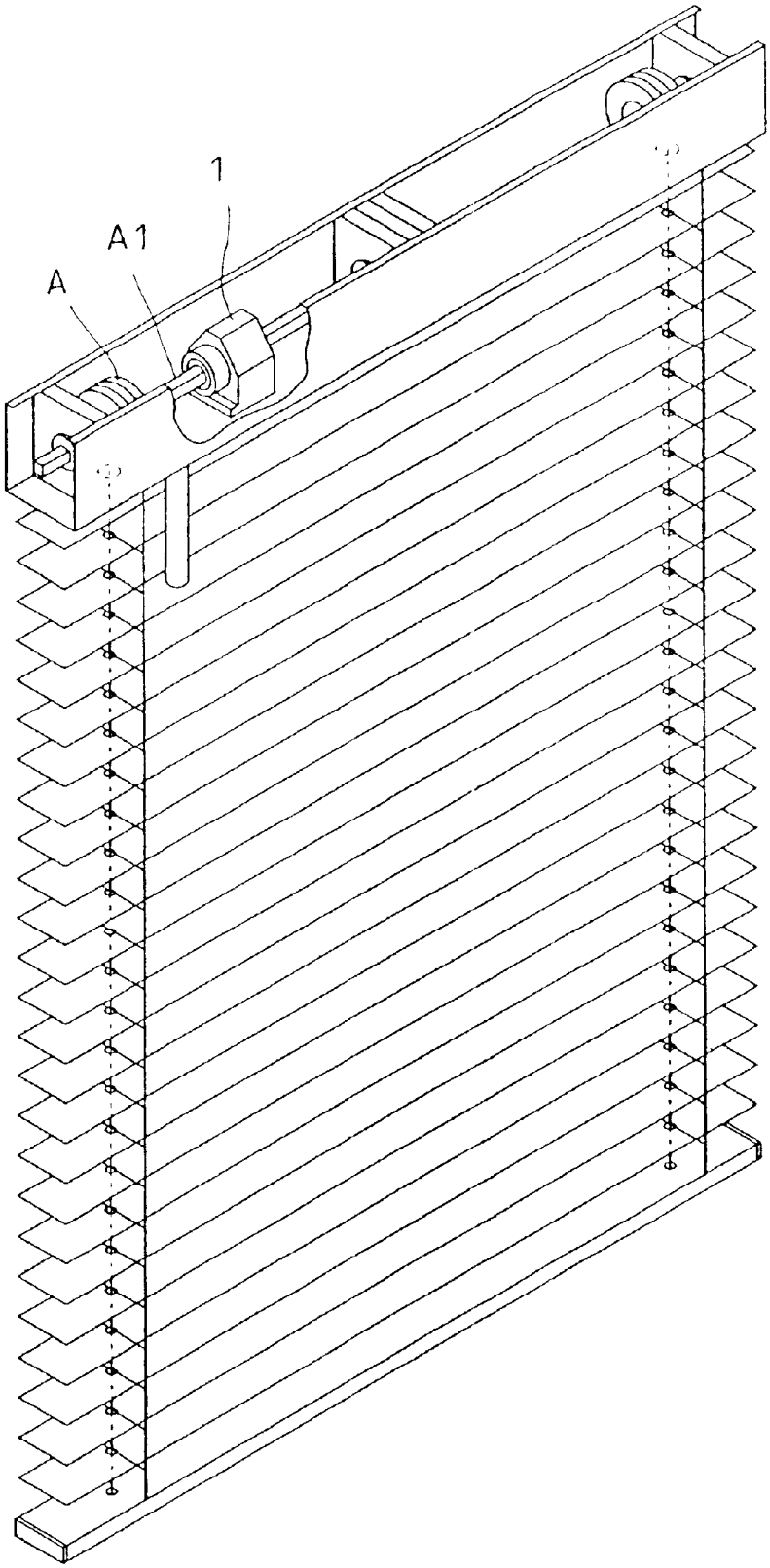
FIG. 1 illustrates the installation of a lift lock in a blind according to the present invention.
Figure 2:
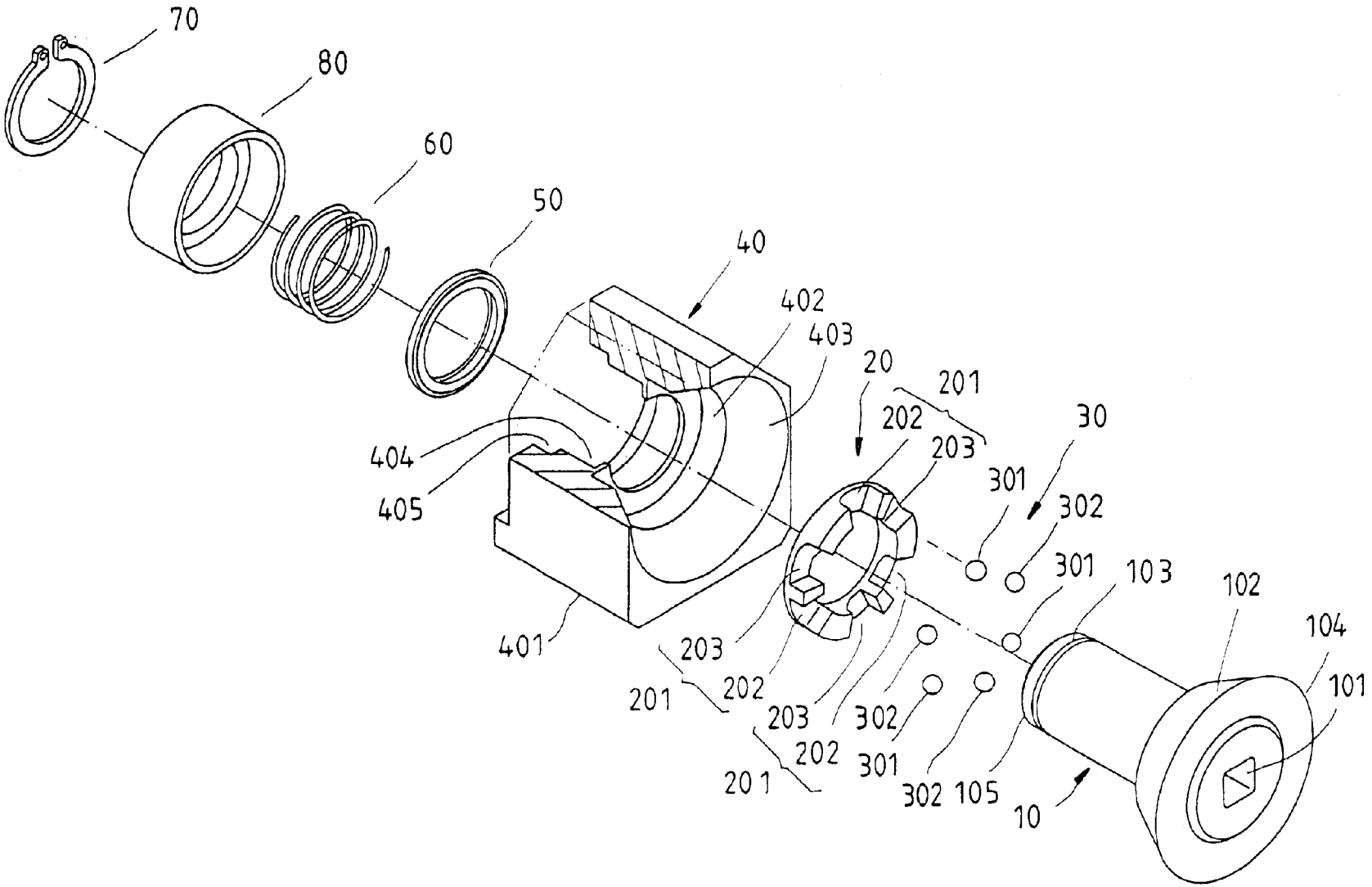
FIG. 2 is an exploded view of the lift lock according to the present invention.

As shown in FIGS. 1 and 2, a lift lock 1 is installed in a blind A and coupled to the rectangular lift rod A1 of the blind A, and adapted to lock the lift rod A1. The lift lock 1 is comprised of a shaft 10, a guide wheel 20, balls 30, a casing 40, a cushion 50, a spring member 60, a retainer 70, and a cap 80.

The shaft 10 has a first end 104 of relatively bigger outer diameter, a second end 105 of relatively smaller outer diameter, a rectangular center through hole 101 axially extended through the center of the first end 104 and the second end 105, a cone-like engagement portion 102 at the first end 104 around the rectangular center through hole 101, and a locating portion, for example, an annular locating groove 103 extended around the periphery of the second end 105.

Figure 3:
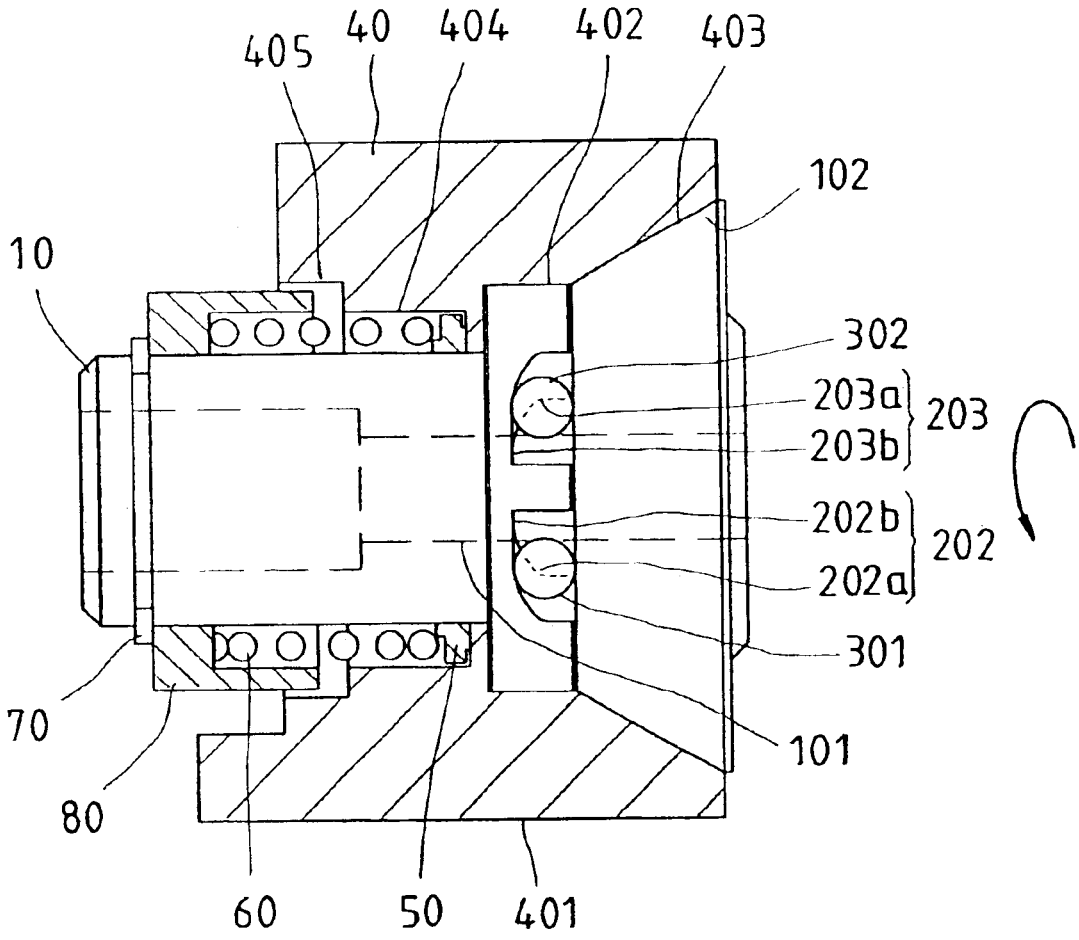
FIG. 3 is a right side view of the lift lock according to the present invention.
Figure 4:
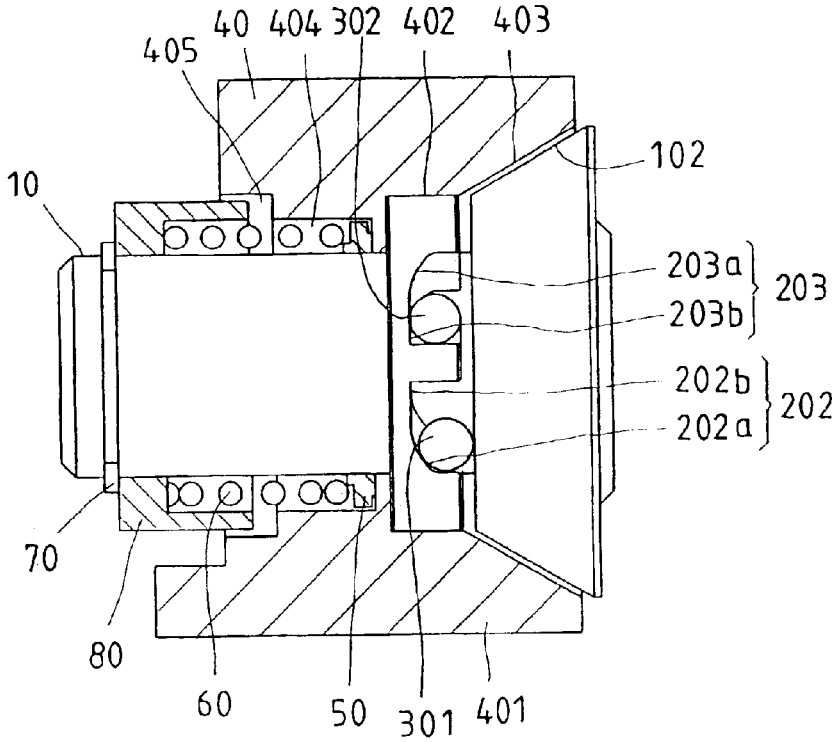
FIG. 4 is a sectional view of the lift lock according to the present invention, showing one positioning status of the balls in the sliding grooves of the guide wheel.
Figure 5:
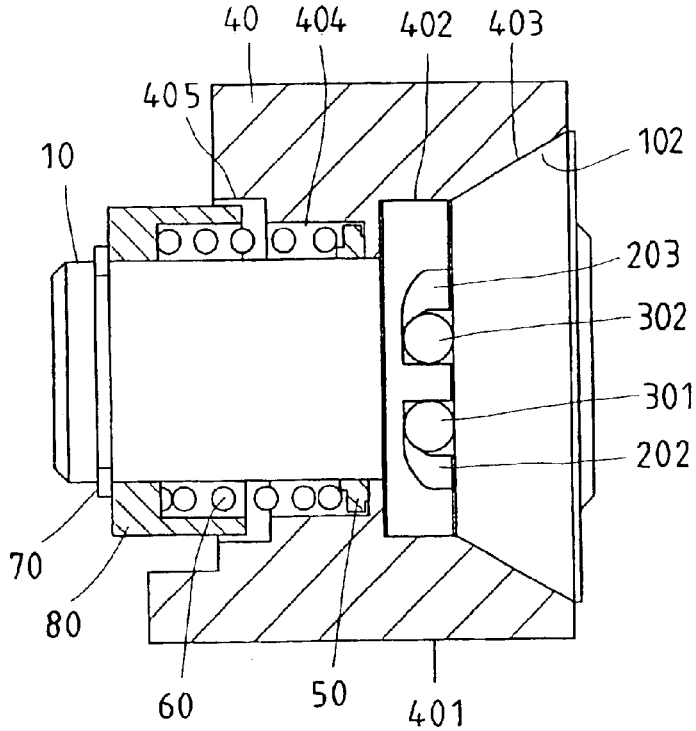
FIG. 5 is similar to FIG. 4 but showing another positioning status of the balls in the sliding grooves of the guide wheel.

The guide wheel 20 is an annular member sleeved onto the second end 105 of the shaft 10 adjacent the cone-like engagement portion 102, having symmetrical pairs, for example, three pairs of sliding grooves 201 adapted to receive the balls 30. Each pair of sliding grooves 201 includes a first sliding groove 202 and a second sliding groove 203. The first sliding grooves 202 and second sliding grooves 203 of the pairs of sliding grooves 201 are alternatively equiangularly spaced around the center of the guide wheel 20. As illustrated in FIG. 3, each first sliding groove 202 has an arched shallow projecting end 202*a* and a flat deep receiving end 202*b*. The arched shallow projecting ends 202*a* and flat deep receiving ends 202*b* of the first sliding grooves 202 are alternatively arranged in directly along the periphery of the guide wheel 20. When the ball 30 stopped at the arched shallow projecting end 202*a* of the corresponding first sliding groove 202, it protrudes over the periphery of the guide wheel 20 at a distance. On the contrary, when the ball 30 stopped at the flat deep receiving end 202*b* of the corresponding first sliding groove 202, it is received inside the guide wheel 20. The connection area between the arched shallow projecting end 202*a* and flat deep receiving end 202*b* of each first sliding groove 202 is made gradually deeper in direction from the arched shallow projecting end 202*a* toward the flat deep receiving end 202*b*. Each second sliding groove 203 has an arched shallow projecting end 203*a* and a flat deep receiving end 203*b*. The arched shallow projecting ends 203*a* and flat deep receiving ends 203*b* of the second sliding grooves 203 are alternatively arranged in directly along the periphery of the guide wheel 20 and reversed to the arched shallow projecting ends 202*a* and flat deep receiving ends 202*b* of the first sliding grooves 202. The number of the balls 30 is equal to the number of the sliding grooves 201 of the guide wheel 20, for enabling the balls 30 to be respectively received in the sliding grooves 201.

The casing 40 comprises a hollow body 401 defining an axially extended stepped through hole formed of a positioning opening 403 and a first receiving chamber 402 in one end and a second receiving chamber 404 and a third receiving chamber 405 in the other end. The hollow body 401 is fixedly fastened to the blind A to receive the shaft 10 and the guide wheel 20. The guide wheel 20 is received in the second first receiving chamber 402, keeping the sliding grooves 201 facing the cone-like engagement portion 102 of the shaft 10. The shaft 10 is inserted through the hollow body 401 of the casing 40, keeping the cone-like engagement portion 102 received in the positioning opening 403. The positioning opening 403 is a tapered opening fitting the cone-like engagement portion 102.

The cushion 50 is sleeved onto the shaft 10 and firmly received in the second receiving chamber 404 of the hollow body 401 of the casing 40. The spring member 60 is sleeved onto the shaft 10 and supported on the cushion 50. The retainer 70 is a C-shaped retaining ring fastened to the annular locating groove 103 of the shaft 10. The cap 80 is a hollow cap axially slidably mounted on the shaft 10 in the third receiving chamber 405 of the casing 40 and supported between the spring member 60 and the retainer 70. The spring member 60 imparts an outward pressure to the retainer 70 (because the cushion 50 is firmly stopped in the second receiving chamber 404 of the casing 40), thereby causing the cone-like engagement portion 102 to be closely received in the positioning opening 403 of the casing 40.

The operation of the lift lock is outlined hereinafter with reference to FIGS. 4 and 5 and FIGS. 1~3 again. When the tilt rod A1 biased counter-clockwise by an external rotary force that surpasses the friction resistance between the shaft 10 and the casing 40, the shaft 10 is rotated with the tilt rod A1. At this time, the balls 30 in the first sliding grooves 202, namely, the first balls 301 are respectively forced to rotate in direction from the respective flat deep receiving ends 202*b* toward the respective arched shallow projecting ends 202*a*, and the balls 30 in the second sliding grooves 203, namely, the second balls 302 are respectively forced to rotate in direction from the respective arched shallow projecting ends 203*a* toward the respective flat deep receiving ends 203*b*. During movement of the first balls 301 and the second balls 302, the guide wheel 20 is forced to bias slightly. However, because the speed and angle of rotation of the shaft 10 are greater than the guide wheel 20, the second balls 302 are maintained in the respective flat deep receiving ends 203*b*, and the first balls 301 are moved to the respective arched shallow projecting ends 202*a*. When the first balls 301 moved to the respective arched shallow projecting ends 202*a*, they protrude over the periphery of the guide wheel 20 and are stopped against the cone-like engagement portion 102 of the shaft 10 to force the cone-like engagement portion 102 away from the positioning opening 403 of the casing 40 (see FIG. 4), enabling the shaft 10 to be synchronously rotated with the lift rod A1.

When the input counter-clockwise torque of the lift rod A1 became smaller than the friction resistance between the shaft 10 and the casing 40, the shaft 10 is forced by the spring force of the spring member 60 to move axially relative to the casing 40, thereby causing the cone-like engagement portion 102 to be fitted into the positioning opening 403. At the same time, the first balls 301 are forced by the periphery of the cone-like engagement portion 102 to move to the flat deep receiving ends 202*b* of the respective first sliding grooves 202. Therefore, the cone-like engagement portion 102 is maintained in close contact with the periphery of the positioning opening 403 of the casing 40 to stop the shaft 10 from rotation (see FIG. 5).

On the contrary, when the tilt rod A1 biased clockwise by an external rotary force that surpasses the friction resistance between the shaft 10 and the casing 40, the cone-like engagement portion 102 of the shaft 10 is forced outwards from the positioning portion 403 of the casing 10. At this time, the first balls 301 are respectively forced by the rotating shaft 10 to the respective flat deep receiving ends 202*b*, and the second balls 302 are respectively moved to the respective arched shallow projecting ends 203*a*. When the second balls 302 moved to the respective arched shallow projecting ends 203*a*, they protrude over the periphery of the guide wheel 20 and are stopped against the cone-like engagement portion 102 of the shaft 10 to force the cone-like engagement portion 102 of the shaft 10 away from the positioning opening 403 of the casing 40, enabling the shaft 10 to be synchronously rotated with the lift rod A1.

When the input clockwise torque of the lift rod A1 became smaller than the friction resistance between the shaft 10 and the casing 40, the shaft 10 is forced by the spring force of the spring member 60 to move axially relative to the casing 40, thereby causing the cone-like engagement portion 102 to be fitted into the positioning opening 403. At the same time, the second balls 302 are forced by the periphery of the cone-like engagement portion 102 to move to the flat deep receiving ends 203*b* of the respective second sliding grooves 203. Therefore, the cone-like engagement portion 102 is maintained in close contact with the periphery of the positioning opening 403 of the casing 40 to stop the shaft 10 from rotation.

In general, the invention provides the following advantages:

1. The friction design between the casing and the shaft and the arrangement of the symmetrical pairs of sliding grooves in the guide wheel and the balls in the sliding grooves enable the lift rod to be accurately locked in the desired angular position after each forward or backward adjustment.

2. The design of the three symmetrical pairs of sliding grooves causes the radial components of force produced from the balls to compensate one another, enabling the balls to accurately provide the desired axial push force.

3. The lift lock is an independent module that can be installed in any part of the lift rod. During installation, the shaft of the lift lock is sleeved onto the lift rod and moved along the lift rod to the desired location, and then the casing is fixedly fastened to the headrail of the blind.

4. Because the engagement portion of the shaft is shaped like a cone, the shaft produces a high friction resistance when engaged into the positioning opening of the casing and, the dimension of the whole assembly is minimized.

5. Because the casing has a second receiving chamber and a third receiving chamber for receiving the cushion, the spring member and the casing, the outer appearance of the lift lock looks in unity.

6. Because the whole structure of the lift lock is simple, the manufacturing cost of the lift lock is low.

What is claimed is:

1. A lift lock for locking position of a rotatable lift rod of a blind when a rotary driving force applied to the lift rod is dropped below a predetermined value, said lift lock comprising:

a shaft having a first end, a second end, a non-circular center through hole axially extended through the first end and the second end and fitted onto one end of the lift rod, an engagement portion at said first end, and a locating portion at said second end;

a guide wheel sleeved onto said shaft and having a plurality of first sliding grooves and a plurality of second sliding grooves alternatively spaced around one side thereof, said first sliding grooves and said second sliding grooves each having a shallow projecting end and a deep receiving end, the shallow projecting ends and deep receiving ends of said first sliding grooves are arranged in clockwise direction along the periphery of said guide wheel, the shallow projecting ends and deep receiving ends of said second sliding grooves are arranged in counter-clockwise direction along the periphery of said guide wheel;

a plurality of balls respectively received in the sliding grooves of said guide wheel;

a casing provided with a hollow body having a positioning opening in one end thereof adapted to receive the engagement portion of said shaft, and a first receiving chamber disposed inside said positioning opening and adapted to receive said guide wheel;

a retainer coupled to the locating portion of said shaft; and a spring member sleeved onto said shaft and stopped between said retainer and said casing and adapted to force the engagement portion of said shaft into engagement with the positioning opening of said casing.

2. The lift lock as claimed in claim 1, wherein said first sliding grooves and said second sliding grooves are respectively gradually made deeper in direction from the respective shallow projecting end toward the respective deep receiving end.

3. The lift lock as claimed in claim 1, wherein the shallow projecting end of each of said first sliding grooves and said second sliding grooves is arched, and the deep receiving end of each of said first sliding grooves and said second sliding grooves is flattened.

4. The lift lock as claimed in claim 1, wherein said engagement portion of said shaft is a cone; said positioning opening of said casing is a tapered opening fitting the cone of said engagement portion.

5. The lift lock as claimed in claim 1, wherein said locating portion of said shaft is an annular locating groove extended around the periphery of the second end of said shaft; said retainer is a C-shaped retainer fastened to the annular locating groove of said shaft.

6. The lift lock as claimed in claim 1, further comprising a cushion sleeved onto said shaft and stopped between said spring member and said casing.

7. The lift lock as claimed in claim 6, wherein said casing further has a second receiving chamber disposed in an opposite end thereof and adapted to receive said cushion and said spring member.

8. The lift lock as claimed in claim 1, further comprising a hollow cap sleeved onto said shaft and disposed between said spring member and said retainer.

9. The lift lock as claimed in claim 8, wherein said casing further comprises a third receiving chamber adapted to receive said hollow cap.

10. The lift lock as claimed in claim 1, wherein said first sliding grooves and said second sliding grooves are equiangularly spaced around one side of said guide wheel.

* * * * *